US007517138B2

(12) United States Patent
Guyot

(10) Patent No.: US 7,517,138 B2
(45) Date of Patent: Apr. 14, 2009

(54) WATCH CONTROL DEVICE

(75) Inventor: Alain Guyot, La Chaux-de-Fonds (CH)

(73) Assignee: Bruno Affolter S.A., La Chaux-de-Fonds (CH)

( * ) Notice: Subject to any disclaimer, the term of this patent is extended or adjusted under 35 U.S.C. 154(b) by 1 day.

(21) Appl. No.: 11/576,176

(22) PCT Filed: Sep. 27, 2005

(86) PCT No.: PCT/EP2005/054840

§ 371 (c)(1),
(2), (4) Date: Mar. 28, 2007

(87) PCT Pub. No.: WO2006/037739

PCT Pub. Date: Apr. 13, 2006

(65) Prior Publication Data

US 2007/0280056 A1 Dec. 6, 2007

(30) Foreign Application Priority Data

Oct. 8, 2004 (CH) ..... 1661/04

(51) Int. Cl.
*G04B 37/00* (2006.01)

(52) U.S. Cl. ..... 368/184; 368/267; 368/319

(58) Field of Classification Search ..... 368/191–198, 368/184, 308, 319, 267, 243, 268–271, 75
See application file for complete search history.

(56) References Cited

U.S. PATENT DOCUMENTS 320,609 A 6/1885 Wiseman
367,995 A 8/1887 Morlet
602,036 A 4/1898 Prahl
2004/0160859 A1 * 8/2004 Germiquet et al. ..... 368/14

FOREIGN PATENT DOCUMENTS

CH 16959 6/1898

(Continued)

OTHER PUBLICATIONS

Automated English Translation (Abstract Only) of above Foreign Patent (D) No. EP 0869412 as obtained from website http://www.espacenet.com (English translation was available of Abstract only.

(Continued)

*Primary Examiner*—Vit W Miska
*Assistant Examiner*—Sean Kayes
(74) *Attorney, Agent, or Firm*—Townsend M. Belser, Jr.; Nexsen Pruet, LLC

(57) ABSTRACT

Control device for a watch movement having a part rotatably movable around an axis A. The device is associated with a watch case (11) and has a lock (25) actuatable from outside the watch. The lock is movably mounted in translation to the periphery of the watch case (11). The device also has a movably mounted plate (30) which is rotatable around an axis D inside the watch case and is kinematically connected to the lock. An arm (34) is pivotable around and axis B, whose first end is placed on the plate in such a way that it is freely rotatable around an axis C non-merging with the axis D and whose other end is fixed to the part for driving the movement.

12 Claims, 3 Drawing Sheets

FOREIGN PATENT DOCUMENTS

| | | | |
|---|---|---|---|
| EP | 0443086 | A1 | 9/1990 |
| EP | 0869412 | A2 | 3/1998 |
| EP | 0952499 | A1 | 4/1998 |
| WO | WO 00/36473 | | 6/2000 |

OTHER PUBLICATIONS

English translation of EP 0443086 A1 (E above).
Automated English Translation (Abstract Only) of above Foreign Patent No. EP 0952499 (listed as H above) as obtained from website http://www.espacenet.com (English translation was available of Abstract only).

Enclosed Patent No. 6,203,189 B1 that Issued Mar. 30, 2001 is believed to be equivalent to EP0952499 (H above).

International Search Report PCT/EP2005/054840 related to subject application.

* cited by examiner

WATCH CONTROL DEVICE

TECHNICAL FIELD

The present invention relates to horology. More specifically, it concerns a control device of the type designed to actuate, from the outside of its case, a mechanism of a watch movement.

BACKGROUND

Certain mechanisms, such as that known to those skilled in the art as a "minute repeater", are generally actuated by a rotational movement of a component provided with a toothed sector that is caused to pivot directly by a circular sliding of a push-piece in the middle of the watch case.

One problem with this construction is that it can only be used on a round case because the path of the push-piece is necessarily circular, otherwise the connection with the component with the toothed sector cannot be direct.

One of the objects of the invention is to make it possible to actuate a mechanism of this kind by the translational movement of a push-piece along a curve close to a straight line rather than by a circular sliding action. The path of this translational movement has an infinite radius of curvature when applied to a rectangular case, but it may also have a radius of curvature of typically more than two times the width of the case, when applied to a so called tonneau case.

SUMMARY OF THE INVENTION

More precisely, the invention relates to a watch mechanism control device comprising a component rotatable about an axis A. The device is designed to be fitted to a watch case and comprises a push-piece actuatable from the outside of the case.

According to the invention, the push-piece can be moved translationally along the periphery of the case and the device includes, housed in the watch case:

- a plate mounted, rotatably about an axis D, inside the case, and connected kinematically to said push-piece, and
- an arm hinged about an axis B, with one end arranged over the plate and free to rotate about an axis C that does not coincide with axis D, and the other end fixed to the component for actuating the mechanism.

The push-piece occupies a first extreme position when it is at rest. Advantageously it is acted upon by an elastic member for moving it to and keeping it in this first position. The elastic member may be a spring acting on a rod connected detachably to the push-piece.

The rod ends in a cam designed to act on a pin located on the plate.

There is also a second problem with the prior-art devices. Since the movement of the push-piece in the case is of about 25°, it is very difficult to seal the connection between the movement and the push-piece around so large a sector, while allowing the control device to move.

A second object of the invention is to provide a sealed push-piece type control device.

For this purpose, in the device provided above, the rod slides within a housing formed by a separate component attached to the watch case. This separate component is a strip that comprises, in the vicinity of one of its ends, a housing through which the rod passes and in which an O ring is to be placed.

BRIEF DESCRIPTION OF THE DRAWINGS

Other details will become clearer on reading the description which follows, which refers to the accompanying drawing, in which.

DETAILED DESCRIPTION

Figure 1A:
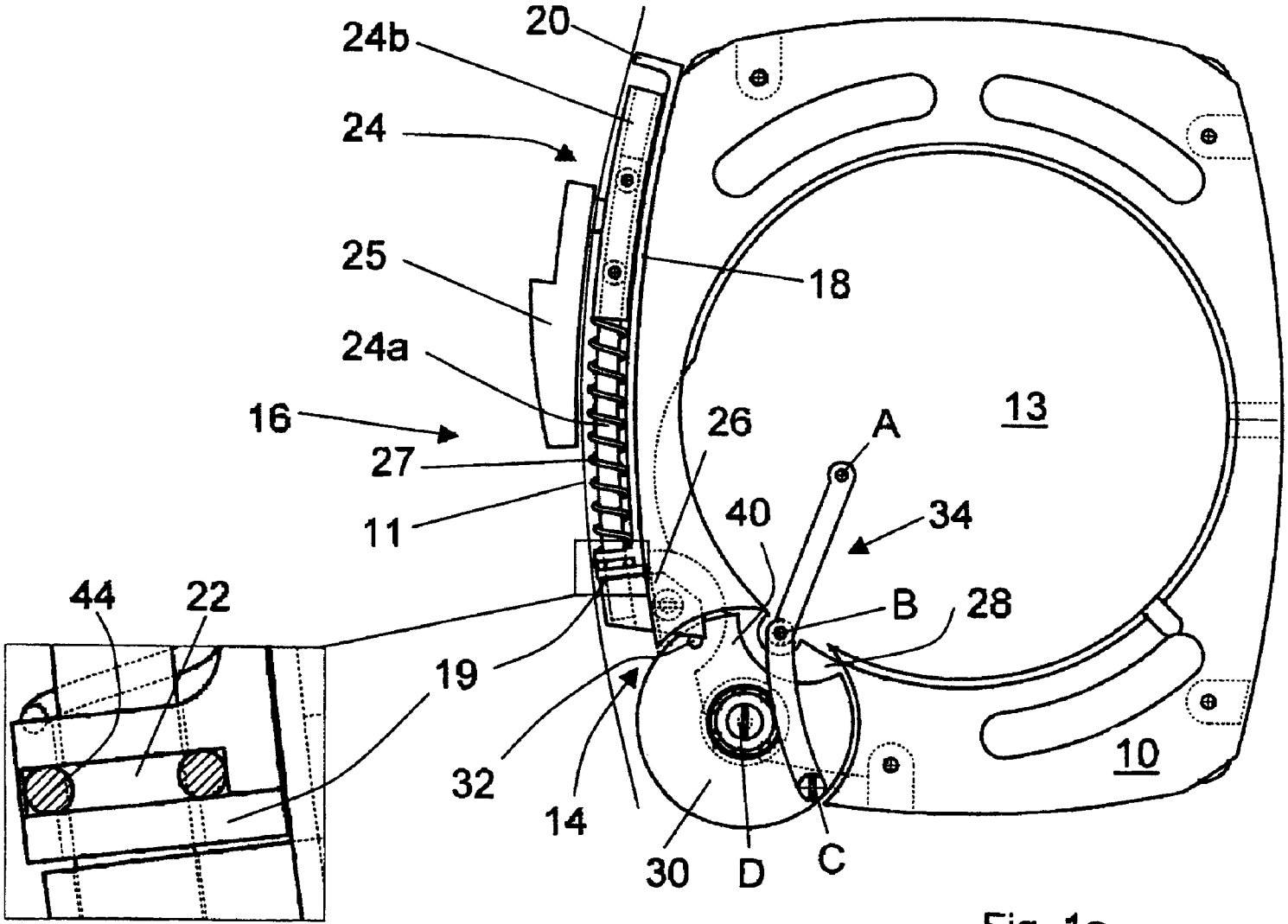
FIGS. 1*a* and 1*b* are top views of the mechanism in its first and second extreme positions, FIG. 1*a* also including an enlarged view of a detail.

The figures show a barrel-shaped casing ring 10 designed to sit in a tonneau watch case 11 whose middle 12 is of the same shape. The casing ring 10 contains a housing 13 for a watch movement (not shown) and its external outline matches the shape of the inside of the case. As an example, the movement may comprise a minute repeating mechanism in which the striking work is triggered by a toothed sector rotating about an arbor A. The drawing shows only the projections of the mechanism's various arbors which are perpendicular to the plane defined by the case 11.

The control device according to the invention sits in a space 14 provided in a corner of the casing ring 10 and extends along the side 16 adjacent to this corner, which is in a space designed to be between the two halves of the wristband.

A housing is provided longitudinally along the outside edge of the side 16. It may for example take the form of a separate component 18 welded to the middle 12 across the entire area of contact between these two parts. This component 18 consists of a strip whose ends 19, 20 are bent out and meet the edge of the case 11.

End 19 is provided with a hole (not visible in the drawing) and with an annular housing 22 whose purpose will be explained later.

A rod 24 slides within the housing and passes through the hole in end 19. This rod 24 comprises two parts: part 24*a* is that nearest the space 14, and part 24*b* is of a greater diameter. The two parts are similar in length and form, at their junction, a stop positioned in about the middle of the rod. The diameter of part 24*a* and that of the openings of the component 18 are an exact fit.

Part 24*b* of the rod is connected detachably to a push-piece 25 designed to project from the watch case. The case has an opening to allow the push-piece 25 to move on its periphery. A cam 26 located in space 14 is fixed to the end of part 24*a* of the rod. The shape of the cam 26 will be described in detail later.

A return spring 27 is mounted on the part 24*a* of the rod. At one end it bears on the stop formed at the junction with part 24*b* and at the other on the end 19. Consequently, when the push-piece 25 is actuated, the rod 24 moves translationally in the housing, parallel to the edge of the casing ring 10, compressing the spring 27 in the process, and is returned to its rest position by the spring 27 when the push-piece is released and the spring 27 relaxes.

The space 14 continues into an opening 28 situated on the dial side, in which there sits a plate 30 pivoting about an arbor D on the casing ring 10. The thicknesses of the back of the opening 28 and of the plate 30 are such as to ensure that the cam 26 is situated in a plane higher than the plane of the plate 30.

The plate 30 is provided with a pin 32 at its periphery, in the plane of the cam 26. The device also includes an arm 34 hinged at an elbow of axis B. One end of the arm 34 is arranged over said plate and is free to rotate about an axis C which does not coincide with axis D. Axis C is preferably situated at the periphery of the plate 30. The second end of the arm 34 is fixed to the toothed sector of the minute repeating mechanism in order to actuate it.

The dimensions of the hinged arm 34 and of the plate 30 are such that the toothed sector of the minute repeating mechanism pivots through an angle of approximately 25° about axis A.

Thus, for example, the part of the arm 34 mounted on the plate is 7.2 mm long and that fixed to the toothed sector actuating the minute repeating mechanism is 7.8 mm long. Meanwhile the plate 30 has a diameter of 9.4 mm. Axis C is approximately diametrically opposite the pin 32. The length of the first part of the above arm 34 is less than the diameter of the plate 30, so a notch 40 is formed in the periphery of the latter to allow the second part of the arm, which is in the thickness of the plate 30, not to collide with the latter.

To assemble the above mechanism in the case 11, the rod 24 is placed in the housing formed by the component 18. The casing ring 10 and the movement are then installed in the case 11 and the push-piece 25 is connected to the rod 24. Finally, as is routine for those skilled in the art, the case is sealed shut, on one side by the glass and on the other by the back of the case 11. Similarly, the winding stem is assembled in a sealed manner.

Figure 2:
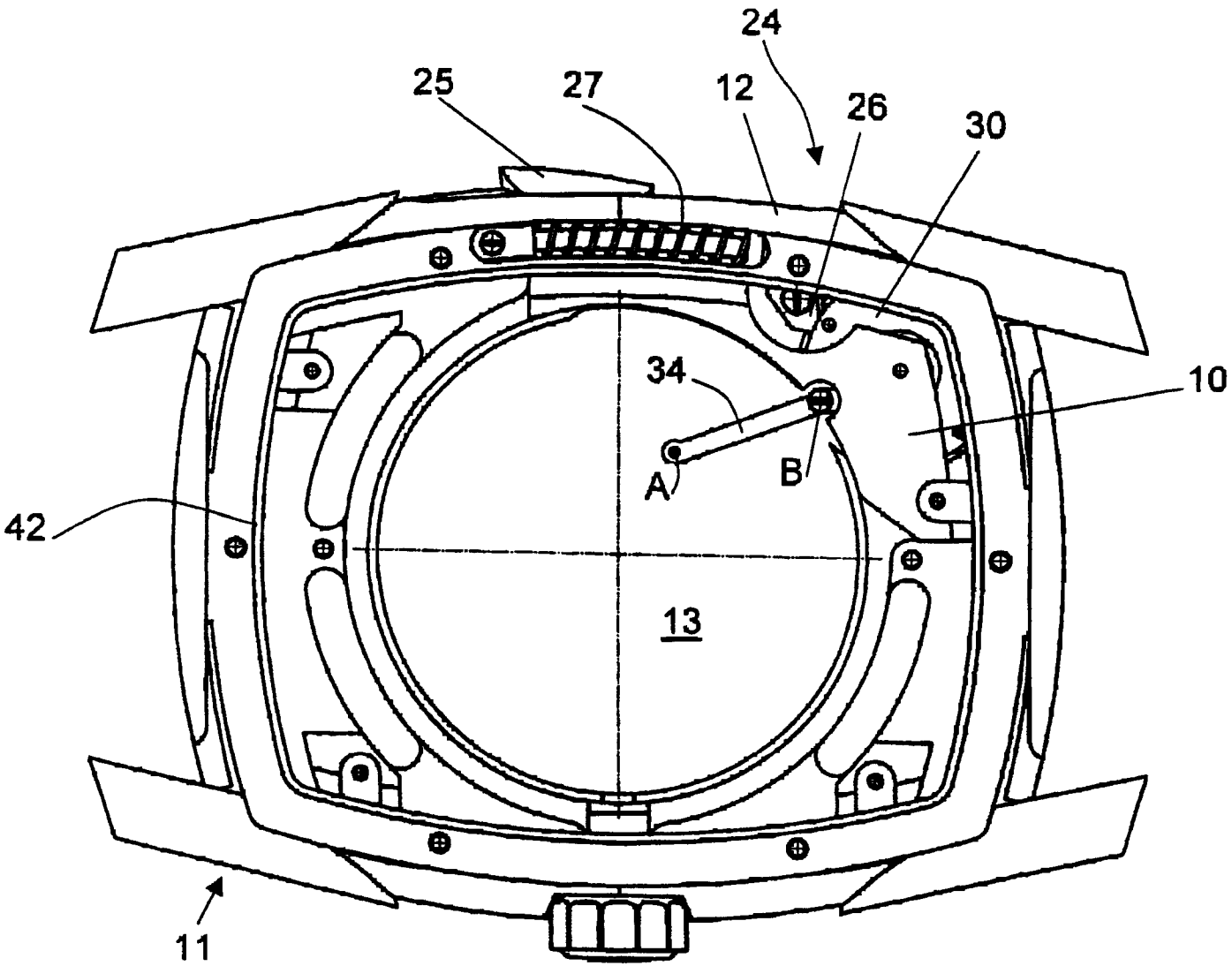
FIG. 2 is a view of the back of the watch case incorporating this device.

More specifically, to fit the back, a seal 42 (visible in FIG. 2) is conventionally laid in a groove formed around the inside perimeter of the case 11. The presence of this seal 42 means that the only opening not yet sealed between the movement and the outside of the watch is around the rod 24, more precisely at the point where it passes through the openings of the component 18.

As shown particularly in the enlarged view in FIG. 1*a*, the shape of the component 18 described above means that it is possible to insert an O ring 44 in the housing 22 for the part 24*a* of the rod to pass through. This part 24*a* can slide freely because the O ring 44 is kept in position between the two walls of the housing 22.

Thus, when the case back is fitted, the conventional sealing systems (glass, winding stem and back) combined with the O ring 44 fitted around the rod 24 completely isolate the movement from external influences.

At rest, as FIG. 1A shows, the push-piece 25 and the rod 24 are pushed by the spring 27 to a first extreme position. The cam 26 is resting on the outside of end 19 of the component 18, which acts as a stop. More specifically, the cam 26 is in the shape of a right-angled trapezoid. The pin 32 rests on the angle formed between the long base and the oblique side of the cam 26. The arm 34 is held in this position by the striking barrel of the minute repeating mechanism to which they are connected via the pivot about axis A.

Figure 1B:
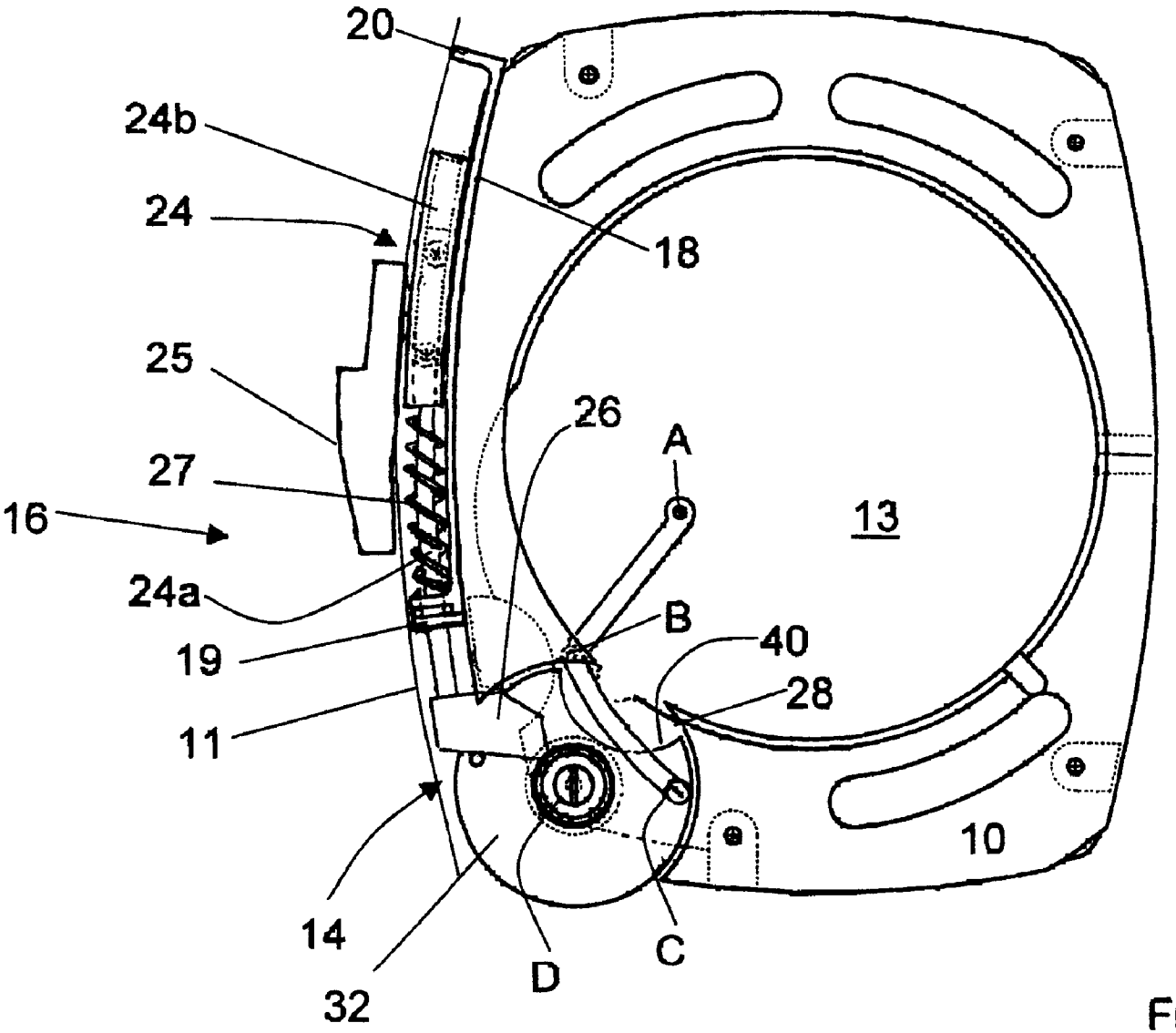

When the person wearing the watch wishes to operate the minute repeating mechanism, he or she pushes the push-piece 25 to move the rod 24 along the inside of the track. The cam 26 pushes against the pin 32, which slides along its long base, turning the plate 30 counterclockwise. Axis B moves around the perimeter of the plate, C moves to the position shown in FIG. 1*b*, and A pivots upon itself, turning the rack of the minute repeating mechanism and thereby winding the striking barrel and triggering the mechanism. The device is now in its second extreme position.

As has been seen above, the rod 24 and the push-piece 25 are returned automatically to their rest position by the spring 27. The arm 34 and the plate 30 are moved back to their first rest position at the same time as the repeating mechanism, the striking barrel of which also returns to the rest position.

The invention thus provides a control device for a circularly actuated mechanism that fits a non-round watch case and yet keeps it leaktight.

What is claimed is:

1. A watch mechanism control device comprising a component rotatable about a first axis, said device being designed to be fitted to a watch case and comprising a push-piece actuatable from the outside of the watch, wherein said push-piece can be moved translationally along the periphery of said case and in that it also includes, housed in the watch case:

a plate mounted, rotatably about a second axis, inside said case, and connected kinematically to said push-piece, and an arm hinged about a third axis, with one end arranged over said plate and free to rotate about a fourth axis that does not coincide with said second axis, and the other end fixed to said component for actuating the mechanism.

2. The device as claimed in claim 1, in which said push-piece occupies a first position when it is at rest, wherein said push-piece is acted upon by an elastic member for moving it to and keeping it in said first position.

3. The device as claimed in claim 2, wherein said elastic member is a spring acting on a rod connected detachably to said push-piece.

4. The device as claimed in claim 3, wherein said rod ends in a cam designed to act on a pin located eccentrically on said plate.

5. The device as claimed in claim 4, wherein said rod slides within a housing formed by a separate component attached to the watch case.

6. The device as claimed in claim 5, wherein said separate component is a strip, one of whose ends comprises a housing through which the rod passes and in which an O ring is to be placed.

7. The device as claimed in claim 3, wherein said rod slides within a housing formed by a separate component attached to the watch case.

8. The device as claimed in claim 7, wherein said separate component is a strip, one of whose ends comprises a housing through which the rod passes and in which an O ring is to be placed.

9. The device as claimed in claim 1, wherein said movement is placed in the watch case by means of a casing ring and said device is housed in one side of said casing ring.

10. The device as claimed in claim 9, wherein said plate sits in a corner of the casing ring or of the watch.

11. The device as claimed in claim 1, wherein said translational movement has a radius of curvature of more than two times the width of the case.

12. The device as claimed in claim 1, wherein said translational movement is along a straight line or a curve close to a straight line.

* * * * *